United States Patent [19]

Morris et al.

[11] 4,223,804

[45] Sep. 23, 1980

[54] PERSONAL DEFENSE DEVICE

[76] Inventors: Bob H. Morris; Barbara O. Morris, both of 4243 Myrtle Ave., Long Beach, Calif. 90807

[21] Appl. No.: 34,651

[22] Filed: Apr. 30, 1979

[51] Int. Cl.[3] ..... F41F 15/00

[52] U.S. Cl. ..... 222/3; 222/192; 222/509; 42/1 G; 116/77; 116/214; 116/DIG. 44

[58] Field of Search ..... 222/3, 192, 509, 505; 116/DIG. 44, 214, 77; 42/1 G

[56] References Cited

U.S. PATENT DOCUMENTS

| | | | |
|---|---|---|---|
| 2,782,748 | 2/1957 | Zegarowitz | 116/112 |
| 3,794,791 | 2/1974 | Thomson | 340/321 X |

FOREIGN PATENT DOCUMENTS

| | | | |
|---|---|---|---|
| 1915045 | 10/1970 | Fed. Rep. of Germany | 42/1 G |

*Primary Examiner*—Robert J. Spar
*Assistant Examiner*—Frederick R. Handren
*Attorney, Agent, or Firm*—I. Michael Bak-Boychuk

[57] ABSTRACT

A portable defense device combining a flashlight with a renewable, interchangeable cylinder containing compressed gas which may be used to generate a noise, to disperse dye and/or an odoriferous spray. The compressed gas may be stored in a canister which may take the form of a spray can having the typical articulated dispensing nozzle which is then received in an articulated throat assembly displaced to release the contents by a pivoted trigger engaging a pivoted arm assembly. In the normal state the trigger is aligned over the exit opening of the throat, thus protecting the dispensing nozzle from inadvertent release, and when released the trigger aligns to engage the arm.

5 Claims, 6 Drawing Figures

FIG. 1
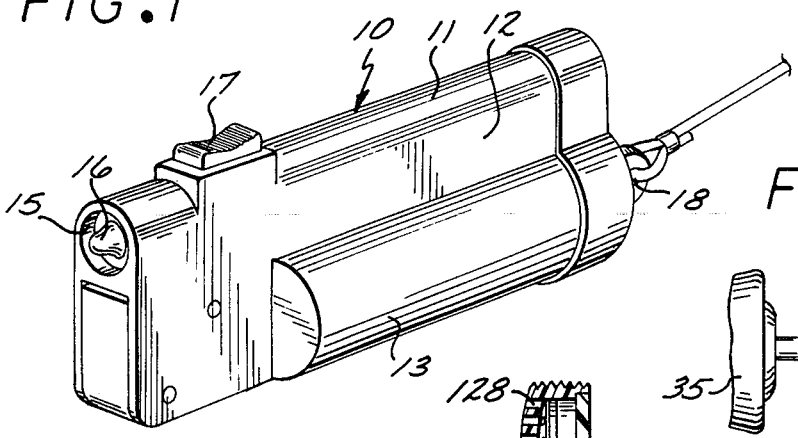
FIG. 5
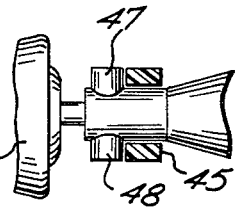
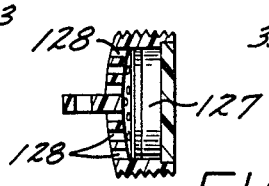
FIG. 6
FIG. 2
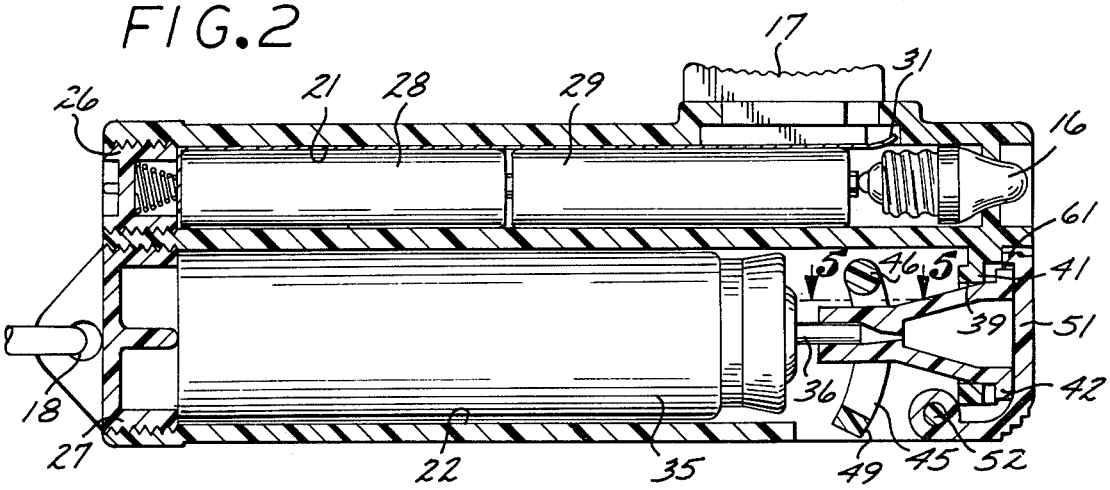
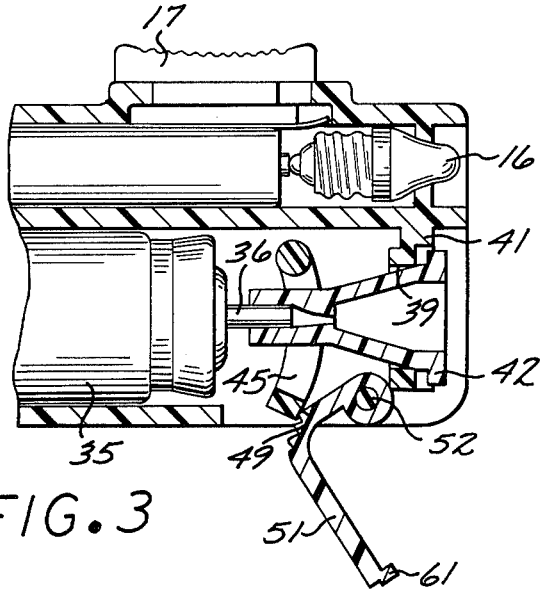
FIG. 3
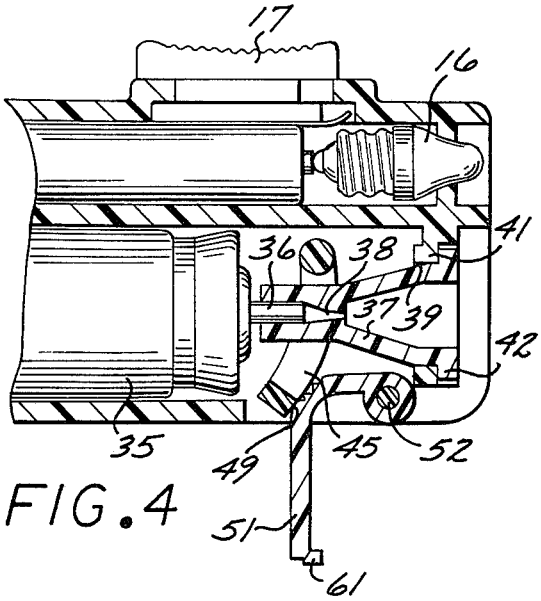
FIG. 4

PERSONAL DEFENSE DEVICE

BACKGROUND OF THE INVENTION

1. Field of the Invention

The present invention relates to personal defense devices and more particularly to alarm and marking devices used to discourage crime.

2. Description of the Prior Art

Personal defense devices have been known in the past. Most typically devices of this kind found in the prior art combine means to generate a loud noise and a dispenser for ejecting dye or odoriferous spray against the attacker. In both latter instances pervasive characteristics in the dye or odor are desired and inadvertent release thereof has posed a major problem to the user.

Since a personal defense device of the foregoing kind achieves its best utility when conformed for convenient use, the necessity of providing effective activation in a failsafe package has long been recognized. For this reason most prior art devices include elaborate circuitry and protective structure to prevent such inadvertent release all accumulating in increased costs and/or lack of reliability.

SUMMARY OF THE INVENTION

Accordingly it is the general purpose and object of the present invention to provide a personal defense device which is reliable in the enabling features thereof.

Other objects of the invention are to provide a defense device including a trigger which in its reposing state shields the activating components against inadvertent release.

Further objects of the invention are to provide a defense device which is combined with a penlight to assist the user during periods of highest criminal risk.

Briefly these and other objects are accomplished in the present invention by providing a substantially elongate housing including a first elongate cavity on the interior thereof formed adjacent a second cavity. Received in the first cavity are the necessary replaceable batteries and switching connectors for exciting a light bulb in one end of the first cavity thus forming a flashlight. The second cavity is conformed to receive a canister of compressed gas which may also store a pervasive dye and/or odoriferous liquid for dispersal. The replaceable canister may be provided with a conventional release nozzle which is received in a sliding throat assembly deployed to translate in one end of the second cavity. The translation of the throat assembly against the closing bias of the nozzle is developed by articulating a pivoted lever suspended in the housing, the lever itself being pushed by a pivoted trigger deployed to lock and to cover the end of the second cavity when not in use. The trigger is provided with latching serrations to lock the throat in a dispensing position once released. This locked activated position can be released with a key or similar object to retain the remaining substance in the canister.

BRIEF DESCRIPTION OF THE DRAWINGS

FIG. 1 is a perspective illustration of a personal defense device constructed according to the present invention;

FIG. 2 is a side view, in section, of the device shown in FIG. 1;

FIG. 3 is a detail view, in section, illustrating a partial articulation of the trigger for enabling the device set out herein;

FIG. 4 is a detail view illustrating components shown in FIG. 3 in the final deployment position of the trigger;

FIG. 5 is a detail sectional view taken along line 5—5 of FIG. 2; and FIG. 6 is a sectional view of the horn useful with the invention herein.

DESCRIPTION OF THE SPECIFIC EMBODIMENT

As shown in FIGS. 1–5, the inventive defense device, generally designated by the numeral 10, comprises an elongate housing 11 formed as a substantially rectangular enclosure 12 provided with an enlarged tubular section 13 proximate one longitudinal edge thereof. Formed in one end of enclosure 12 is a lamp opening 15 fitted with a lamp 16 which may be turned on by a sliding switch 17 on the spine of the enclosure 12. Thus the device 10 may be used as a pen light for opening door locks, being provided with a lanyard or key chain opening 18 at the rear end thereof.

Formed on the interior of enclosure 12 and the enlarged section 13 are two elongate adjacently disposed cavities 21 and 22, cavity 21 extending from lamp opening 15 through the interior of enclosure 12 to terminate in a threaded cap 26 at the back end while cavity 22 is aligned below cavity 21 within the enlarged section 13. Similar to cavity 21, cavity 22 includes a threaded cap 27 for access, and it is this cap that is provided with the aforementioned opening 18. Received on the interior of cavity 21 are two batteries 28 and 29 connected in series to lamp 16, the circuit being completed across a switch contact 31 articulated to close by switch 17. Batteries 28 and 29 are conventional dry cell batteries arranged in a stack within the cavity and compressed for contact by a spring 32 received in the end cap 26.

Cavity 22, on the other hand, is conformed to receive a compressed gas container 35, of the type often referred to as a spray can, the spray end of the container including a nozzle 36 which when pushed into the container will release the pressurized contents thereof. To control the direction of any emitted spray nozzle 36 is inserted at the free end into the interior of a throat assembly 37 which in its structure may include the necessary interior convolutions 38 to form a whistle upon the passage of the released gases therethrough. Throat assembly 37 is free to translate along with the translation of nozzle 36, the free end of the throat assembly being received in an end orifice 39 formed in housing 11 immediately subjacent the lamp opening 15. To limit the inward stroke of the throat assembly and accordingly the stroke of nozzle 36 end orifice 39 is surrounded by a seating surface 41 conformed to engage a peripheral bead 42 formed around the exterior of the throat. In this form a controlled inward stroke of the throat assembly is provided, controlling the articulation stroke of nozzle 36. The articulation of the throat assembly 37 is achieved by a forked pivotally suspended lever 45 pivoted around a pivot post 46 deployed in housing 11 adjacent the throat assembly lever 45 engaging two opposed cylindrical projections 47 and 48 extending from the throat. The free end of lever 46, in turn, is disposed for engagement by a pivoted trigger 51, once more suspended from a pivot post 52 and conformed as a generally L-shaped structure pivoted around the free end of one of the legs thereof.

In the normal state, as shown in FIG. 2, trigger 51 is aligned to dispose the free leg thereof over the orifice 39, thus shielding the throat assembly 37 from inadvertent articulation. This alignment, furthermore, provides an effective shield for collecting any dye or odorized liquid which may be released because of container failure. To limit the inward stroke of the trigger the free edge thereof is provided with a lip 61 directed to engage the surface around the seat 41. Thus the lip 61 and the post 52 provide the structural support for the trigger 51, opposing any direct application of force to the throat assembly.

When it is desired to release the contents of canister 35 the trigger 51 is rotated about a pivot post 52 to advance the apex of the L against the free end of the forked lever 45. This alignment, according to the illustration in FIG. 3, exposes the free end of the trigger 51 for further application of force as may be necessary to articulate the nozzle 36 to release the stored contents. In order to maintain the nozzle in a dispensing state the apex of the L-shaped trigger is conformed to include serrations which engage the free end of the lever 45.

Thus, under adverse conditions the user upon articulating the trigger latches the canister into a dispensing state releasing the contents until exhausted. Prior to this release the canister is shielded and protected against inadvertent release, being safely available for repeated use as a flashlight. If the device is removed from the hand during a confrontation the device will continue to emit the sound and odor until all the contents are released.

As an added feature the closure cap 27 may be altered according to the illustration in FIG. 6. In this implementation cap 27 includes an electrically driven buzzer 127 producing sound through a plurality of orifices 128. This buzzer or horn assembly may be energized either by way of a further switch position of switch 17 or by the pressure of canister 35.

Obviously many modifications and changes can be made to the foregoing description without departing from the spirit of the invention. It is therefore intended that the scope of the invention be determined solely on the claims appended hereto.

What is claimed is:

1. A personal defense device comprising:

a hollow housing including a first elongate cavity formed on the interior thereof, said first cavity terminating in an orifice at one end thereof;

a container of compressed gas received on the interior of said first cavity, said container including a dispensing nozzle at one end thereof adapted to dispense said compressed gas upon the inward articulation thereof, said container being aligned in said first cavity to deploy said nozzle towards said orifice;

a throat assembly generally formed as a conical frustum surface engaging the nozzle and providing a discharge flow path for the compressed gas issuing from the nozzle, said throat assembly disposed in the cavity at said one end and aligned to translate within said orifice to effect the articulation of said nozzle, said throat assembly including two exteriorly directed opposed projections on the exterior thereof;

a pivoted lever suspended inside said housing for pivotal articulation and aligned to translate said projections on said throat assembly thereby; and a pivoted trigger assembly conformed as an L-shaped surface hinged at one end within said housing proximate said throat assembly and adapted to align the free leg thereof over said orifice in one position thereof and to movably engage said lever in another position thereof.

2. Apparatus according to claim 1 wherein:

said trigger includes serrated surfaces aligned for mating engagement with said lever assembly in said second position of said trigger.

3. Apparatus according to claim 2 wherein:

said lever assembly is conformed to advance said throat assembly and said nozzle to release said compressed gas upon the engagement of said serrated surfaces.

4. Apparatus according to claim 3 further comprising:

a second cavity formed in said housing and including a lamp at one end thereof; and battery means stored in said second cavity for excitation of said lamp.

5. Apparatus according to claim 4 further comprising a buzzer stored in said housing and adapted for selective connection to said batteries.

* * * * *